US007967277B2

(12) United States Patent
Chambers

(10) Patent No.: US 7,967,277 B2
(45) Date of Patent: Jun. 28, 2011

(54) COMBINATION HAND TOOL BAR

(75) Inventor: Daniel Chambers, Bushnell, IL (US)

(73) Assignee: Vaughan & Bushnell Manufacturing Company, Hebron, IL (US)

( * ) Notice: Subject to any disclaimer, the term of this patent is extended or adjusted under 35 U.S.C. 154(b) by 0 days.

(21) Appl. No.: 12/042,598

(22) Filed: Mar. 5, 2008

(65) Prior Publication Data

US 2008/0217592 A1 Sep. 11, 2008

Related U.S. Application Data

(60) Provisional application No. 60/893,018, filed on Mar. 5, 2007.

(51) Int. Cl.
*B66F 15/00* (2006.01)

(52) U.S. Cl. ..... 254/25; 7/166

(58) Field of Classification Search ..... 269/270; 254/25, 18, 21; 7/166
See application file for complete search history.

(56) References Cited

U.S. PATENT DOCUMENTS

| | | | | |
|---|---|---|---|---|
| 1,221,323 | A | 4/1917 | Hill | |
| 1,445,263 | A | 2/1923 | Asper | |
| 1,486,820 | A * | 3/1924 | Wilder | 254/25 |
| 1,890,273 | A | 12/1932 | Wells | |
| 2,330,092 | A * | 9/1943 | Armand | 254/25 |
| 2,896,910 | A | 7/1959 | Cooper et al. | |
| 2,937,004 | A * | 5/1960 | Striani | 254/131 |
| 3,680,834 | A * | 8/1972 | Holloway | 254/25 |
| 6,629,684 | B2 | 10/2003 | Youngren | |
| D596,913 | S | 7/2009 | Anderson et al. | |
| 2007/0114501 | A1 * | 5/2007 | Eby et al. | 254/25 |
| 2008/0217592 | A1 | 9/2008 | Chambers | |

OTHER PUBLICATIONS

A/C Pry Bar & Rippers, www.ajctools.com, 1 page.
Hook Bar, Vaughan & Bushnell Mfg. Co., Buyer's Guide Home, Jul. 13, 2010, 1 page.

* cited by examiner

*Primary Examiner* — Lee D Wilson
*Assistant Examiner* — Jamal Daniel
(74) *Attorney, Agent, or Firm* — Lackenbach Siegel, LLP; Andrew F. Young, Esq.

(57) ABSTRACT

In accordance with the present invention, there is provided a combination hand tool bar device suitable for pulling nails and other materials from surfaces, with improved user ergonomics and efficient force transfer. The device includes a hook end and a pry end joined by a bar shank member interposed there between. The hook end further comprises a compound curve projecting in the same direction from the bar shank member as the pry end enabling an increased user throw and ergonomic comfort.

7 Claims, 7 Drawing Sheets

D
E
1
10
2
16
9
201
120

3
13'
11
12
S
12'
F2
D1

Fig. 2A
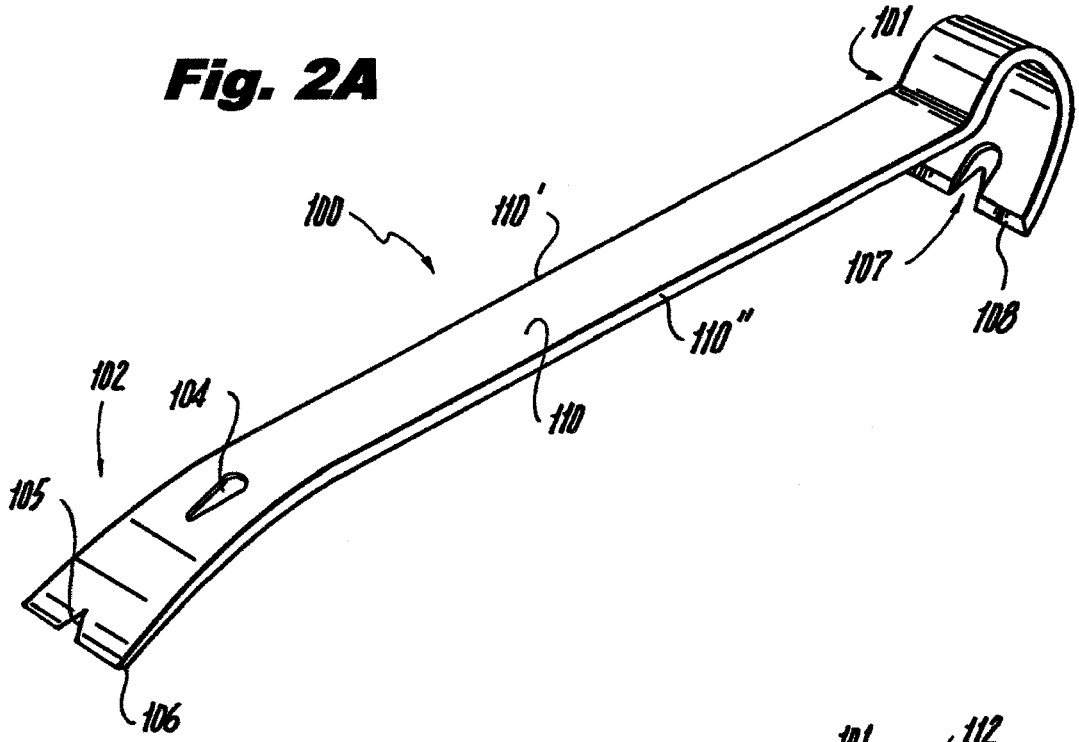
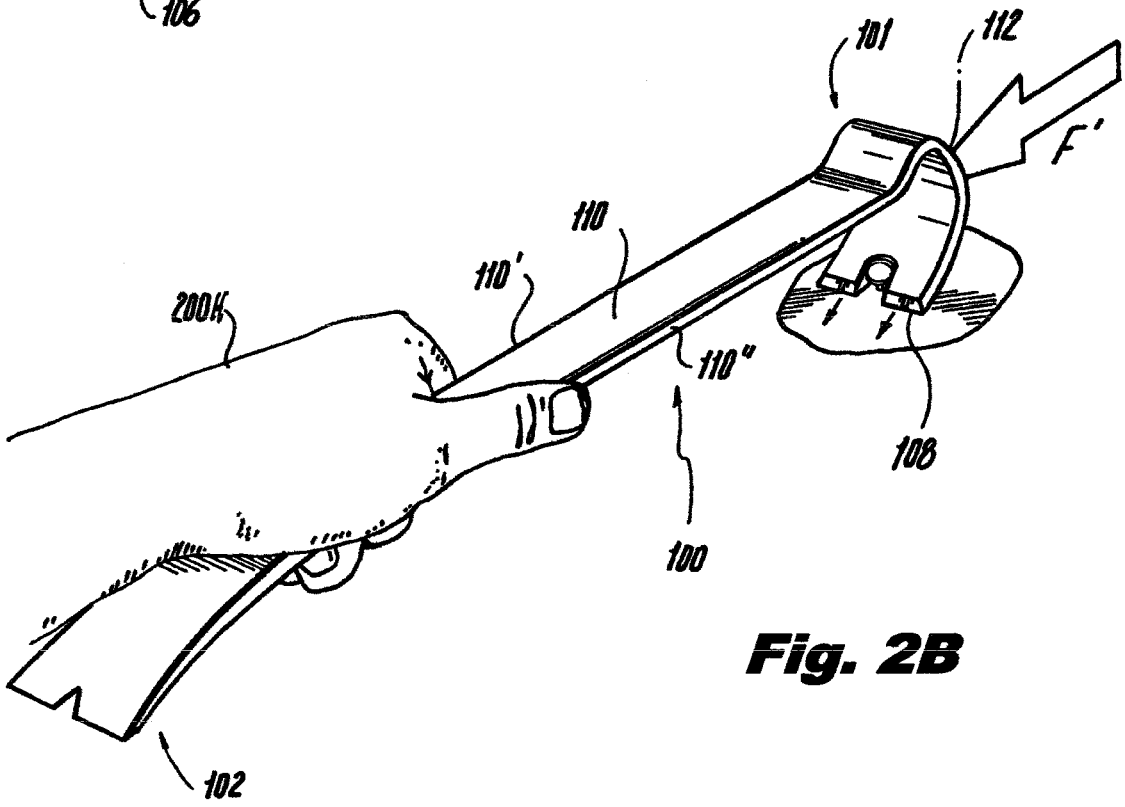
Fig. 2B

A
B
C
Q
100
101
113
120'
201
F2'
112
D2
102
107
108
114
115
116
110

A'
B'
C'
14
Z
200
201
216
120"
213
210
214
215
207
208
212
F2"
D3

COMBINATION HAND TOOL BAR

CROSS REFERENCE TO RELATED APPLICATION(S)

This application relates to and claims priority from U.S. Prov. Ser. No. 60/893,018 filed Mar. 5, 2007, the entire contents of which are herein incorporated by reference.

BACKGROUND OF THE INVENTION

1. Field of the Invention

The present invention relates generally to a nail-pulling device having combined nail-pulling ends. More specifically, the present invention relates to a combination prying and nail-pulling device that provides a user with improved comfort, leverage, and overall ergonomic success, as well as to a method for employing the device to effect nail removal 2. Description of the Related Art The related art involves the use of traditional tools to pry materials from surfaces such as nails affixed to flooring, walls, or roofing.

Using traditional tools, the nails are removed from such surfaces with a claw hammer or similar device. Optionally, a standard crowbar or other prying tool is used to pry the materials (such as adhered laminates from a counter top). The surfaces may be flat or curved, and may farther be angled. With respect to particularly difficult-to-remove items, and more particularly on difficult-to-access surfaces such as roofs or slanted walls, removal can be difficult since conventional prying tools tend to be generally straight or with very short (less than 90 degree) single-curve hooked pulling heads.

Such straight or hooked pulling heads do not provide sufficient leverage against the angled or awkwardly positioned surfaces, and pulling materials is difficult and slow, requiring repeated pulling to remove materials with a large surface area. Additionally, when dealing with particularly large materials (such as roofing tiles), the short curved surface is generally too short in length to provide an efficient detachment of the materials. Alternatively, when employing a conventional longer-slopped prying end positioned below such a roofing tile, the prying/lifting distance is detrimentally reduced by the construction geometry of the hooking member on an opposite end of the sloped prying end.

Conventional nail pulling and prying devices are recognized in the prior art. One common category of such devices are crowbar-type lever devices, which comprise a pulling head that is inserted under a particular material to be removed and a long shank, wherein prying-force is applied at the end of the shank opposite the head.

As can be seen in U.S. Pat. No. 6,629,684 (Youngren et al.) many crowbar type devices often employ a so-called "hooked" head, resulting in a single fulcrum (or single pivot point) relatively close to the head. In addition, the hooked head is relatively short, sometimes with an angle between the shaped portion of the hook and the shank at or near 90 degrees. This relatively limited curvature combined with the generally linear lever member projecting there from limits both the distance to which the hook can be inserted under the material to be pried, and the throw-distance through which a user may comfortably move the pry bar shank to achieve the pulling required. Additionally, this conventional construction also limits the position of a user's hands when initially locating the hook end under the item to-be-lifted (e.g. the head of a nail).

If the material is long or large, this shape requires the user to make repeated and incremental pulling-movements to remove long or large materials, particularly large sheeted materials such as roofing tiles, or where a nail is long (6 inches long or more) repeated pullings are required. Where the head is merely angled at approximately 90 degrees, the leverage to be applied is limited by the range of lever-motion the user can make before encountering the surface itself, i.e., the wall or roof, this phrase is used herein generally as referring to the user throw distance (the full range of lever-motion). In these cases, the nail pulling operation is inefficient since the upward motion of the material to be pulled is very limited by the shorter lever-motion range available, and may not exceed the length of the nail preventing removal. Lastly, many related art devices cause damage to the surface from which the materials are pulled where the pulling motion damages or creases the support surface. Some of these devices have two pry blades at opposite ends, with the opposing blade extending transversely to each other or in contrasting directions from each other.

Generally included in this category of pulling tools is the common claw-tooth hammer, which has a relatively short shank compared to a crowbar. These devices suffer from the drawback of having a short hook, but also from having a construction geometry prohibiting simple urging (driving) of the hook end under an item to be lifted. In such devices, the claw contains the relatively narrow fulcrum, and the curvature of the claw provides the leverage for a handle that projects at best 90 degrees from the pulling surface. While in the art of lever geometry it is known to increase leverage by employing a curve having a greater radius, what is not considered is the human ergonomic function in generating increased leverage when manipulating a very large radius lever. Thus, a solution to improving leverage (a large radius) is actually detrimental to operational use via decreased ergonomic function.

When using a conventional claw-tooth hammer device to remove nails, the claw must be inserted such that the nail shank is trapped between the two teeth of the claw and the nail head contacts the claw surface itself to enable simplified force transfer. As most nails have a very narrow shank, this means that most of the curvature of the claw used for pulling the nail is wasted, as the nail shank is generally trapped only when inserted deeply into the claw, leaving relatively little curvature left to rotate and provide leverage for extracting the nail.

Thus, using conventional art devices having a hooked curve or a very small or no curve, there is insufficient lift area and insufficient throw distance to effectively separate large surface-area materials or long nails from surfaces. In such cases, many small-pulling movements must be taken resetting the two teeth of the claw each time, rather than one or two large pulling actions that loosen much of the material in one movement. The user will appreciate that small pulling movements are inefficient and can cause undue stress on the body itself, particularly when the user is placing force against the lever arm at positions close to the pivot surfaces where interfering items may interfere with movement.

It would therefore be an advantage to have an improved combination nail pulling and prying device that provides both greater leverage and a greater range of movement than prior art devices when removing materials from surfaces, or when removing large or heavy materials. It would also be an advantage to have a combination device, which combines the functionality of a crowbar with an improved ergonomic function allowing a user greater range during force application to pull nails and other materials from surfaces.

As an example, reference is made now to FIGS. 1A, 1B, 1C, and 1D wherein a combination bar 1 is provided having a hook end 2 and a distal prying end 3 spaced by a bar shank member 10 having generally rounded corners 10', 10" for user comfort during gripping.

A nail slot 4 is positioned through bar shank member 10 proximate prying end 3 for use in removing nails retained therein. Opposing nail slots 5, 7 are respectively positioned centrally to pairs of sharp edges 6, 8 respectively as will be discussed.

Referring specifically now to FIG. 1B a common use position is depicted with combination bar 1 positioned projecting upwardly at approximately a 90 degree angle from a surface retaining a nail 9 having a nail shaft 16 (FIG. 1B). As can be seen, sharp edges 8, 8 on hook end 2 have been driven under the nail head of nail 9 by the application of a force F firmly seating the same within nail slot 7 for prying in a direction P, as shown. As can be seen, prying end 3 is projecting away from the direction of hook end 2 relative to a front side 14 and a rear side 15 of bar 1 respectively.

As is noted in the motion of seating, force F is applied to a first contact surface 12 offset a distance 13' from a centerline of bar shank member 10 to force sharp edges 8, 8 about nail shaft 16, in a process generally referred to as seating. While not a suitable use, it is recognized that the opposing hand 200H of a user, positioned to providing force F may approach the support surface too closely and cause injury via slipping of contact surface 12. As a consequence, it is recognized as ergonomically awkward for the user to both position bar tool 1 via bar shank member 10 and provide seating force F while also guiding and positioning. Additionally, as a user's arms approach each to a distance generally less than a user's shoulder width this minimizes the ergonomic efficiency, control, and leverage involved and should be minimized. As a consequence, it is now recognized that a solution is needed that improves a user's ergonomic control and leverage while simultaneously allowing a user's arms to remain at a comfortable separation distance during use.

Referring specifically to FIG. 1C, bar tool 1 is shown positioned after a seating operation beneath head 9 of the nail about nail shaft 16 in a ready-to-lift position. As noted, hook end 2 is positioned on support surface 201, and the slightly curved outer surface of hook end 2 is shown in motion transiting to a contact position at the end of arc E, wherein pry end 3 contacts support surface 201 (distal end of bar 1 not shown).

A throw distance 120 (of approximately 6.5 cm (centimeters) in this example) is noted as the maximum support surface contact distance required by hook end 2 to reach the contact position from the ready-to-lift position. As will be discussed later, throw distance 120 is prohibitively long in an ergonomic and user-comfort sense, and requires a user to swing bar shank member 10 to at least an intermediate position along an arc D at a position 45 degrees off a vertical from support surface 201 to remove shaft 16 from support surface 120. It should be similarly appreciated that throw distance 120 requires movement fully to the contact position approximately 90 degrees off a vertical extending perpendicular from support surface 201 along an arc E to achieve a substantial removal of longer-shafted nails. This longer arc E is ergonomically detrimental because a user is capable of body leverage most comfortably along the shorter arch D (roughly a 45 degree transit on either side of a vertical position), thereby allowing a loss or minimization of leverage at a position between the two arcs (arc E-arc D).

Referring now specifically to FIG. 1D, an additional detriment of the conventionally related art bar shaft 1 is discussed. As shown, pry end 3 is positioned with sharp points 6 bounding shaft 16 thereby seating nail head 9 for an initial lift. This type of positioning is particularly suited for removing shingles or other sheet goods from angled surfaces but, as will be noted, is not an optimal operation in an ergonomic or user-comfort sense.

Due to the contrasting (or opposing) curve directions of pry end 3 and hook end 2 relative to front and back sides 14, 15 of bar 1, a maximum throw distance D1 is defined before sharp ends 8, 8, contact support surface 201. Should nail shaft 16 require additional pulling distance, bar 1 must be repositioned mid-shaft and a lift block included with the lifting/prying action begun again. Thus, those of skill in the art will recognize that it is beneficial to have a maximum throw distance D1 as great as possible for convenient nail removal and ergonomic efficiency.

Additionally, while positioning pry end 3 proximate nail shaft 16, a user may apply an urging force F2 in an attempt to fix sharp ends 6, 6 in a secure manner. Mechanical analysis suggests that the application of a force F2 is maximized when applied in manner best aligned with the length of bar shank member 10 which transmits force F2 to nail head 9. A detriment of the conventional design shown is that the only surface, surface 12', sufficiently perpendicular to the length of bar shank member 10 to receive force F2 is positioned a distance 11 off (away from) a center line of bar shank member 10. Due to this off-center geometry, a number of detriments exist. First, the user providing force F2 along direction S urges surface 12' thereby causing an elastic deflection 18 of hook 2 as force F2 is transmitted around hook 2 to bar shank member 10, and results consequently in a detriment and complementary elastic spring back action tending to dislodge shaft 16 from nail slot 5. Second, due to both the off center geometry and the resultant elastic spring back, the user (not shown) may attempt to present dislodgement by grasping bar shank member 10 proximate hook end 2, thereby placing a body portion in a position of absorbing the energy of said elastic spring back causing ergonomic discomfort and increased safety risk.

As a similar detriment a minor distance 13' is defined between outer surface 12 and the centerline of bar shank member 10. During the prying motion noted in FIG. 1C, it shall be recognized that distance 13' is detrimental to user comfort and security. In motion, the hand or hands 200H of user grasp pry end 3 of bar 1 and move the same along arc E until pry end 3 contacts support surface 201, at this point, due to the narrow range 13' the hand or hands of a user either contact support surface 201 or may closely approach contact support surface 201 sufficient to prohibit the user from using maximum effort.

In a review of the above, those of skill in the art will recognize that what is not appreciated by the prior art is the need for a combination nail-pulling tool with increased user comfort and improved user ergonomics during prying activity on either end.

What is similarly not appreciated by the prior art is the need for a combination nail pulling tool with improved leverage during use and enhanced user throw while having both a pry end and a hook end projecting in a similar direction.

Accordingly, there is a need for an improved combination hand tool bar that responds to these detriments.

OBJECTS AND SUMMARY OF THE INVENTION

An aspect of the present invention is to provide a combination hand tool bar that responds to at least one of the detriments noted above.

Another aspect of the present invention is to provide a combination hand tool bar that provides enhanced ergonomic function, minimizes user discomfort, and increased leverage during operation on both ends of a bar shank member.

The present invention relates to a combination hand tool bar device suitable for pulling nails and other materials from surfaces, with improved user ergonomics and efficient force transfer. The device includes a hook end and a pry end joined by a bar shank member interposed there between. The hook end further comprises a compound curve projecting in the same direction from the bar shank member as the pry end enabling an increased user throw and ergonomic comfort.

According to an embodiment of the present invention there is provided a combination hand tool bar, comprising: a bar shank member spacing a hook end portion at a proximate end and a curved pry end portion at a distal end thereof, the bar shank member defining a first plane having a front side and a back side, the hook end portion and the curved pry end portion extending from the bark shank portion on the same side thereof, whereby the hand tool bar provides increased lever throw and user comfort, and an angle defined between the of the hook end portion and the first plane being less than sixty (60) degrees, whereby the hand tool bar enables an increased leverage during a use.

According to another embodiment of the present invention, the angle is more preferably between approximately 40-50 degrees.

According to another embodiment, the angle is even more preferably between zero (0) and 40 degrees.

According to another embodiment of the present invention, the hook end portion includes an outer arc surface comprising a complex curve, and at least a portion of the complex curve having a tangent generally orthogonal to the first plane of the bar shank member, whereby a force transfer is improved during the use.

The above, and other objects, features and advantages of the present invention will become apparent from the following description read in conduction with the accompanying drawings, in which like reference numerals designate the same elements.

BRIEF DESCRIPTION OF THE DRAWINGS

FIG. 2A is a front perspective view of a combination hand tool bar of the present invention.

FIG. 2B is a perspective view of the combination hand tool bar in FIG. 2A in a first use position.

DETAILED DESCRIPTION OF THE PREFERRED EMBODIMENTS

Figure 1A:
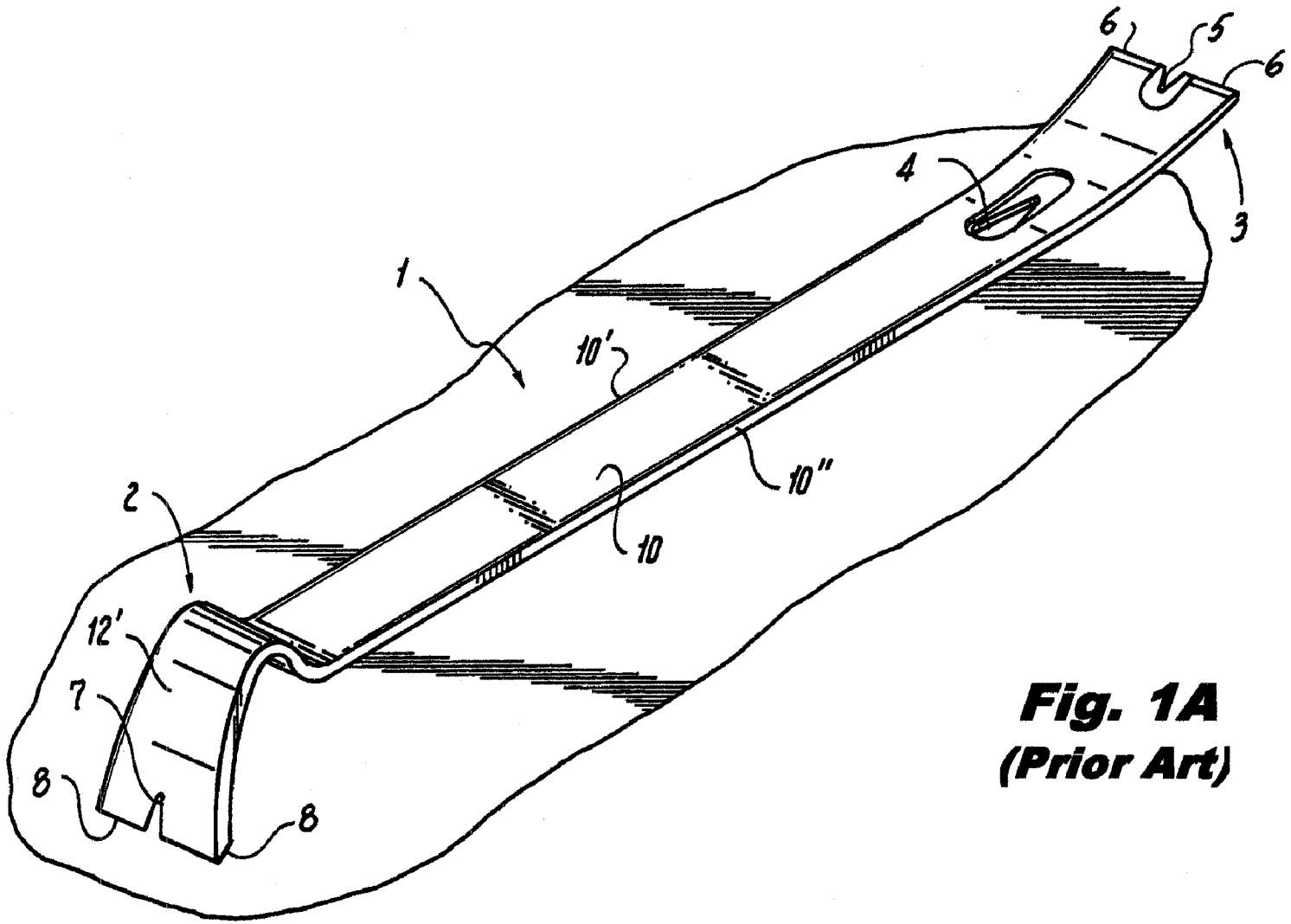
Fig. 1A (Prior Art)
FIG. 1A is a front perspective view of a conventional combination hand tool bar.
Figure 1B:
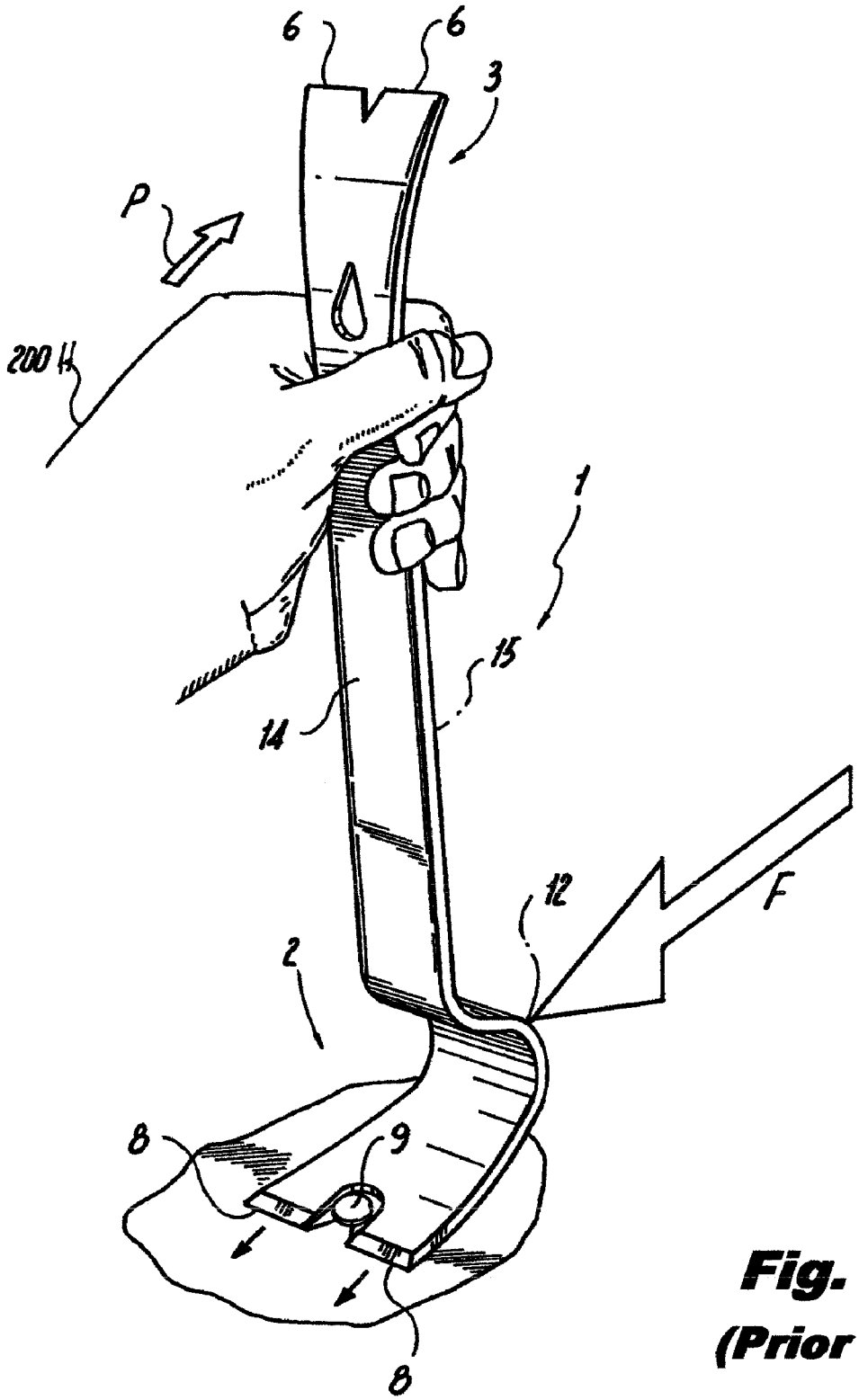
Fig. 1B (Prior Art)
FIG. 1B is a perspective view of the conventional combination hand tool bar in FIG. 1A in a first use position.
Figures 1C, 1D:
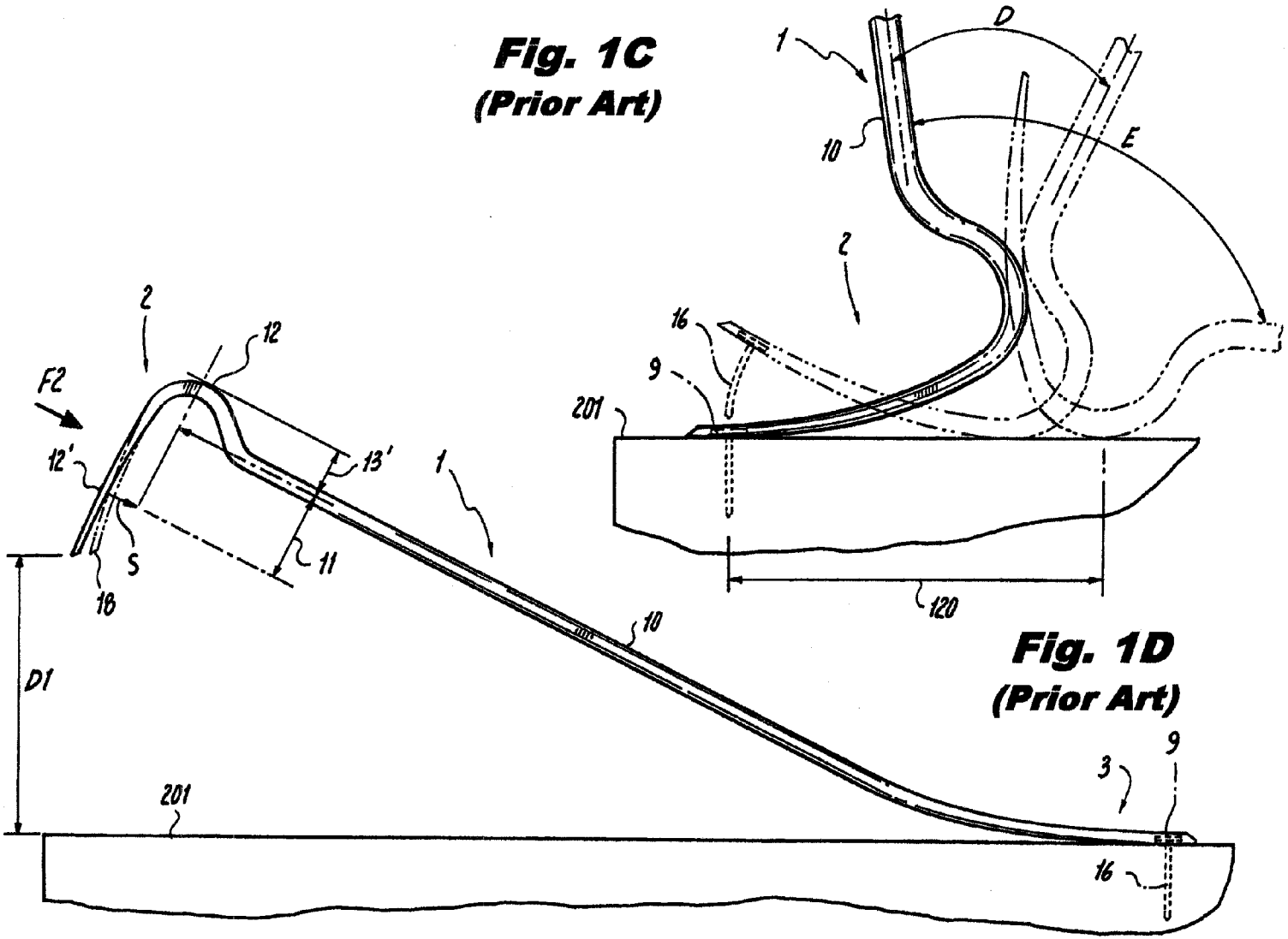
Fig. 1C (Prior Art)
Fig. 1D (Prior Art)
FIG. 1C is a partial side elevational view of the conventional combination hand tool bar in FIG. 1A in a second use position.
FIG. 1D is a second side elevational view of the conventional combination hand tool bar in FIG. 1A in a third use position.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figures 2C, 2D:
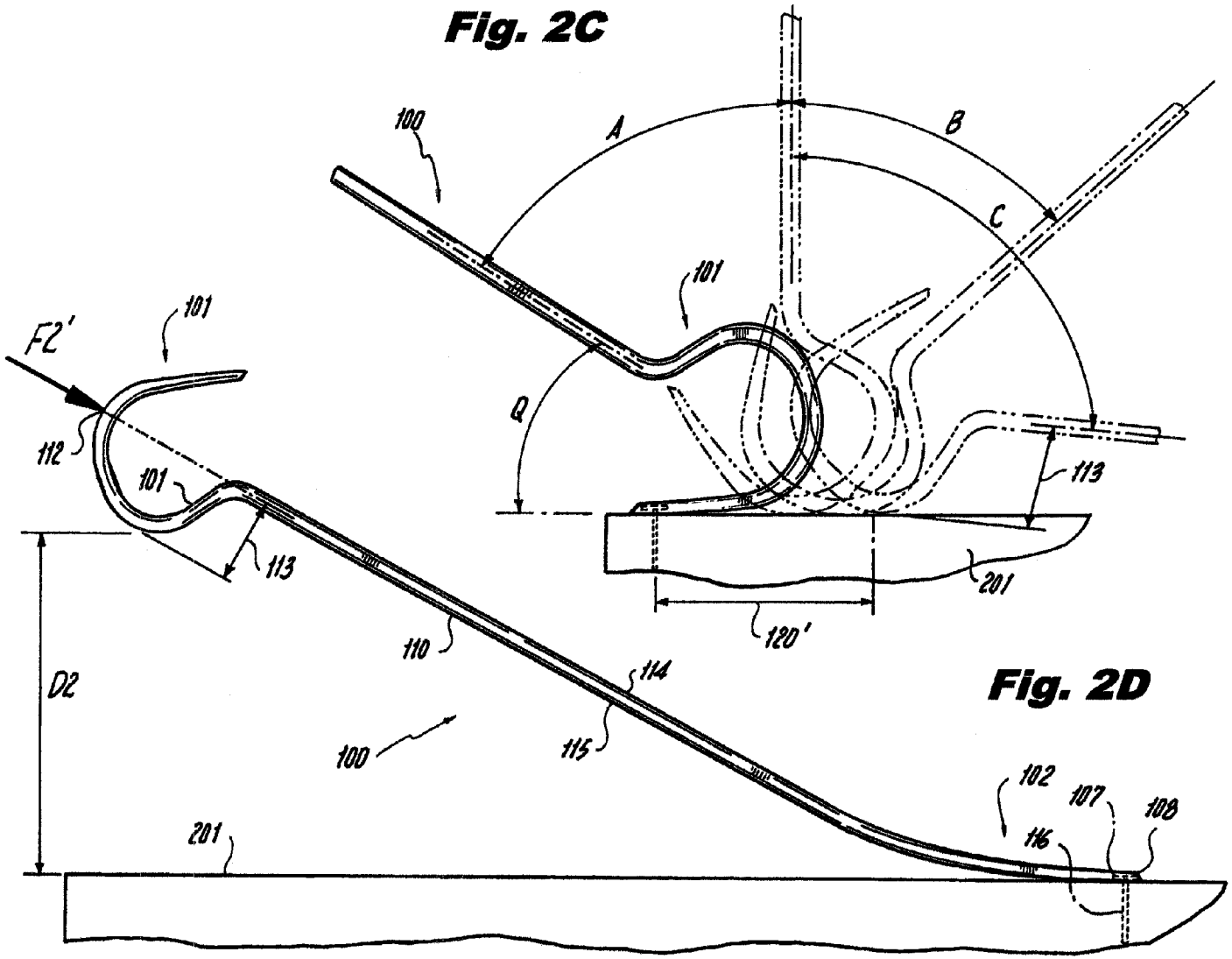
FIG. 2C is a partial side elevational view of the combination hand tool bar in FIG. 2A in a second use position.
FIG. 2D is a second side elevational view of the combination hand tool bar in FIG. 2A in a third use position.

Referring generally to FIGS. 2A to 2D, and specifically now to FIG. 2A, a combination hand tool bar 100 is provided having a pry end 102 and a distal hook end 101 spaced by a bar shank member 110 having generally rounded corners 110', 110" for user comfort during gripping and levering.

A nail slot 104 is positioned through bar shank member 110 proximate prying end 102 for use in removing nails retained therein. Opposing nail slots 105, 107 are respectively positioned centrally to pairs of sharp edges 106, 108 respectively as will be discussed.

A front side 114 is positioned opposite a back or rear side 115 on bar shank member 110. As will be recognized pry end 102 and hook end 101 are both positioned on the same side of bar shank member 110, shown here as front side 114.

Referring now specifically to FIG. 2B, a first use position is noted wherein user, having a left hand 200H is holding bar shank member 110 proximate pry end 102 and positioning sharp edges 108, 108 proximate nail shaft 116. An opposite hand of the user (not shown) applies a force F' to region 112 to urge sharp edges 108, 108 into a seated or set position prior to a levering action.

As a benefit of the present construction, and in contrast to the conventional design above, the user hands need not come into close location or risk contact closer than user-shoulder-width during the application of force F' because bar shank member 110 spaces the hands at distal ends thereof relative to a prying surface 201. Indeed, due to the essential right angle (90 degree) position between the relative directions of bar shaft member 110 and the direction of force F', it is readily apparent that the user left-hand 200H is protected by the length of bar shank member 110 and the downward curvature of pry end 102. Similarly, user hand(s) 200H will not experience any difficulty or awkwardness in securely holding combination bar 100 throughout an entire range of motion. Finally, following a similar analysis a user's hands need not become narrower than the user's own shoulders (based on the spacing of bar shank member 110), thereby enhancing the ergonomic benefits of such use.

Referring now specifically to FIG. 2C a side elevational view of hand tool bar 100 is shown progressing from a first seated position (solid lines matching the position of FIG. 2B) to a second middle position wherein bar shank member 110 is positioned vertically relative to (shown for descriptive purposes in dashed lines), and finally to a third position (shown on the right in dashed lines).

Those of skill in the art will recognize that the first position is shown wherein nail slot 107 engages shank 116 retained within support member 201 (for example a wood floor or joist member). In position one, a first angle Q is designated between the surface of support member 201 and the shown center-line of bar shank member 110. In the present embodiment, first angle Q is approximately between 35-50 or 60 degrees, and preferably at approximately 40-45 degrees. Angle Q is selected for maximum leverage with increased throw distance and increased or enhanced user convenience.

Applicant recognizes that a user's main physiological leverage range (based on the human body) is generally within a 45 degree range on either side of the vertical position shown (as well as the safest range distance from support surface 201), and is noted as second and third angles A and B, respectively. During use, user hand 200H applies pressure or leverage to pry end 102 of bar and rolls the outer surface of hook end 101 along support surface 201, thereby applying sufficient urging force to nail shank 116 to remove the same. As shown here, second and third angles A, B are approximately 45 degrees respectively and provide a number of benefits, including (i) the enhanced ergonomic efficiency of proper placement for a human user hand 200H, (ii) the increased leverage provided by the continuous complex curve noted along the outer surface of hook portion 101, and (iii) the safety provided by having the same-side ends space central shaft 110 from the support surface to minimize user-hand pinching. As will be appreciated the final position of nail shank 116 when bar shank member 110 is at the end of arch B is much greater than in the conventional art, and as a consequence provides an additional leverage benefit.

Finally, it is recognized that the use of a continuous complex curve with an initial low relative angle Q, allows a user to impart smoothly applied power/leverage throughout the beneficial use zone in a continuous movement from first position to third position along a throw distance 120' (approximately 3-4 cm in contrast to the conventional geometry above B bar lengths being substantially equal) that is having a throw distance substantially shorter than throw distance 120 in the conventional art at more than 6.5 cm.

As is depicted in FIG. 2C, a distance 113 is defined between the center of bar shank member 110 and an outermost curve tangent that is parallel with the centerline. Due to the increased distance 113 there is additional safety and user comfort allowing a user's hands (on co-bar pry end 102) to be safely distanced from support surface 201 throughout the range of maximum arc C. As a consequence, there is both increased user comfort and an enhanced leverage range within the same device.

Referring now specifically to FIG. 2D, combination bar 100 is shown with pry end 102 engaging shaft 116 of a nail and nail slot 107 formed between sharp points 108, 108 surrounding the same. Support surface 201 is noted and a throw distance D2 is defined between the maximum outer curvature of hook end 101 and contact surface 201. During use, it will be recognized that throw distance D2 is necessarily greater than conventional throw distance D1 noted above due to the hook direction, thereby providing an enhanced leverage to remove nail shaft 116.

An additional benefit is readily apparent from FIG. 2D as well, in circumstances where user experiences difficulty placing nail slot 107 about nail shaft 116, additional force F2' may be applied along a surface perpendicular to the general centerline of bar shank member 110. The application of force F2' therefore occurs on a portion of the outer hook curve and at a region 112. As will be noted, region 112 is both approximately aligned with the force transfer direction minimizing bending motion/forces, and is applied to a generally thicker and more rigid portion of hook end 101 thereby minimizing substantive elastic motion and detrimental spring back with a resultant similar ergonomic and leverage benefit.

Figure 3A:
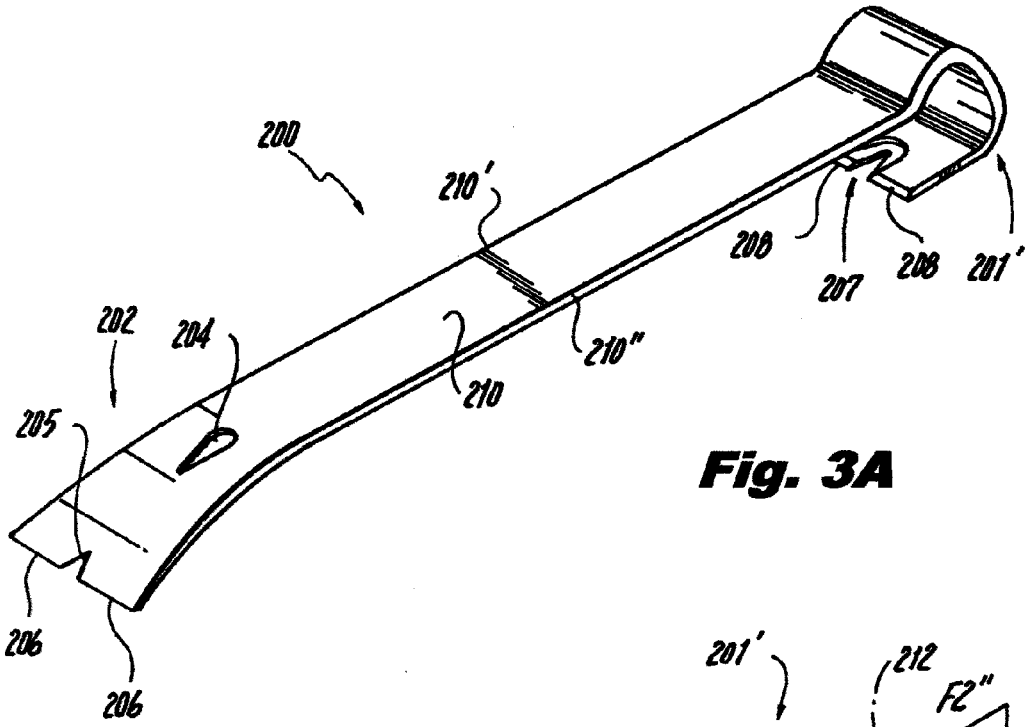
FIG. 3A is a front perspective view of a combination hand tool bar of an adaptive embodiment of the present invention.

Referring generally to FIGS. 3A to 3D, and specifically now to FIG. 3A, an additionally adaptive combination hand tool bar 200 is provided having a pry end 202 and a distal hook end 201' spaced by a bar shank member 210 having generally rounded corners 210', 210" for user comfort during gripping and levering.

A nail slot 204 is positioned through bar shank member 210 proximate prying end 202 for use in removing nails retained therein. Opposing nail slots 205, 207 are respectively positioned centrally to pairs of sharp edges 206, 208 respectively as will be discussed.

A front side 214 is positioned opposite a back or rear side 215 on bar shank member 210. As will be recognized pry end 202 and hook end 201' are both positioned on the same side of bar shank member 210, shown here as front side 214.

Figure 3B:
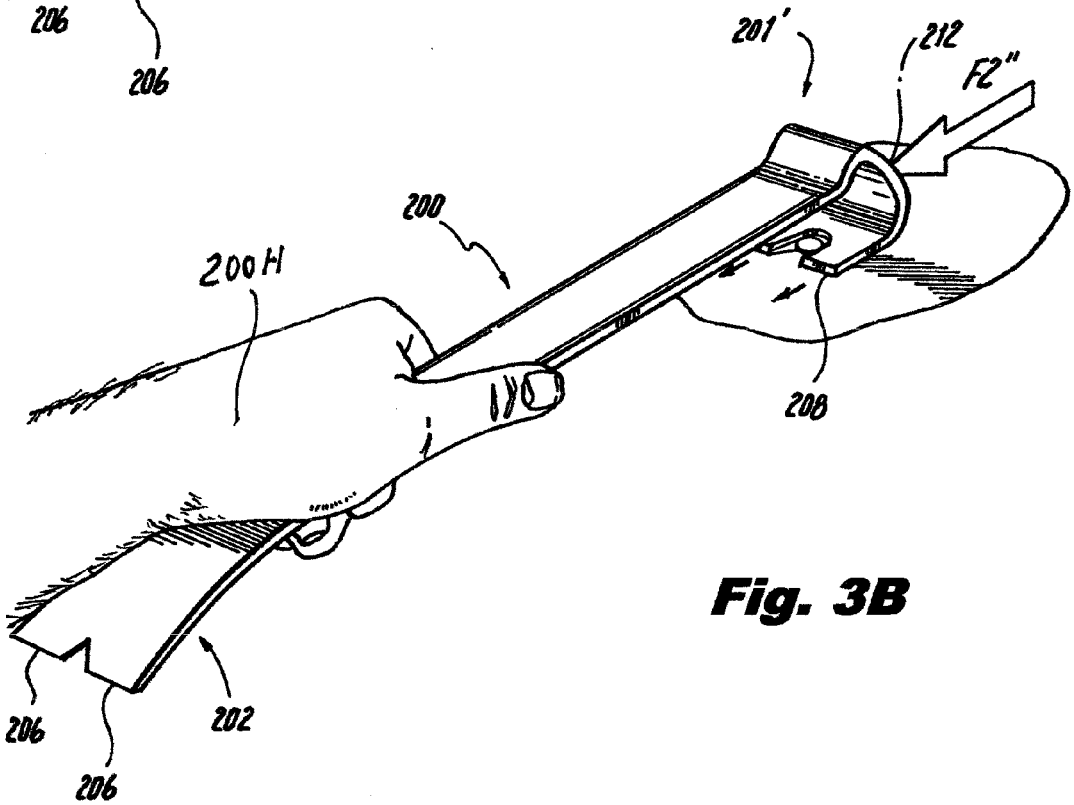
FIG. 3B is a perspective view of the combination hand tool bar in FIG. 3A in a first use position.

Referring now specifically to FIG. 3B, a first use position is noted wherein the user with left hand 200H is holding bar shank member 210 proximate pry end 202 and positioning sharp edges 208, 208 proximate a nail shaft 216. An opposite hand of user 200 (not shown) applies a force F2" to region 212 to urge edges 208, 208 into a seated or set position prior to a levering action.

As a benefit of the present construction, and in contrast to the conventional design above, the hands of a user need not come into close location or risk contact closer than user-shoulder-width during the application of force F2" because bar shank member 210 spaces the hands at distal ends thereof relative to a prying surface 201'. Indeed, due to the essential right angle (90 degree) position between the relative directions of bar shaft member 210 and the direction of force F2", it is readily apparent that the user left-hand 200H is protected by the length of bar shank member 210 and the downward curvature of pry end 202. Similarly, user hand 200H will not experience any difficulty or awkwardness in securely holding combination bar 200 throughout an entire range of motion. Finally, following a similar analysis a user's hands need not become narrower than the user's own shoulders (based on the spacing of bar shank member 210), thereby enhancing the ergonomic benefits of such use.

Figures 3C, 3D:
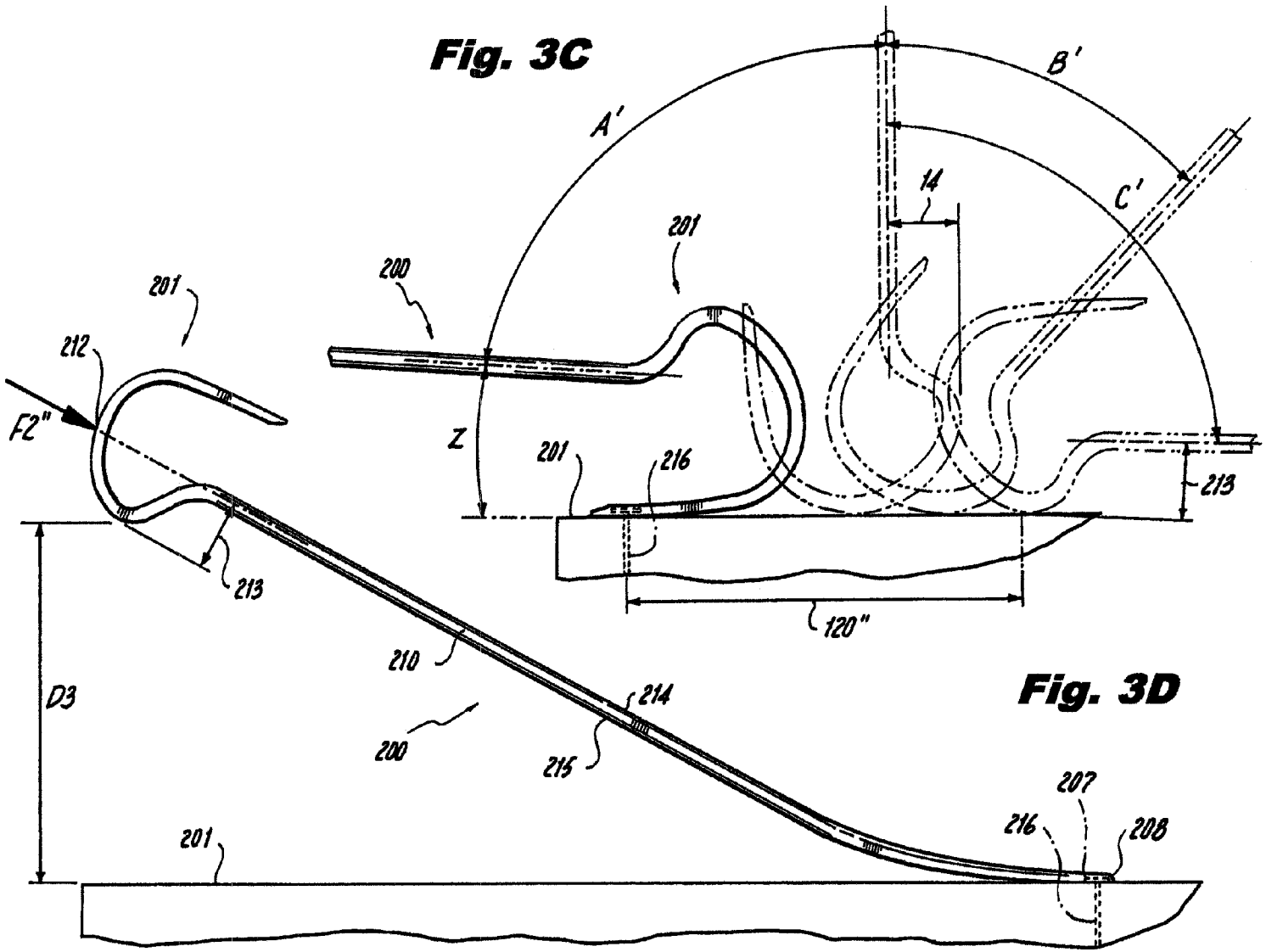
FIG. 3C is a perspective view of the combination hand tool bar in FIG. 3A in a second use position.
FIG. 3D is a perspective view of the combination hand tool bar in FIG. 3A in a third use position.

Referring now specifically to FIG. 3C a side elevational view of hand tool bar 200 is shown progressing from a first seated position (solid lines matching the position of FIG. 3B) to a second middle position wherein bar shank member 210 is positioned vertically relative to (shown for descriptive purposes in dashed lines), and finally to a third position (shown on the right in dashed lines).

Those of skill in the art will recognize that the first position is shown wherein nail slot 207 engages shank 216 retained within support member 201 (for example a wood floor or joist member). In position one, a first angle Z is designated between the surface of support member 201 and the shown center-line of bar shank member 210. In the present embodiment, first angle Z is quite small, approximately between 0-20 or 25 degrees. Angle Z is selected as a balance between maximum leverage with increased throw distance and increased or enhanced user convenience and safety that are not recognized in the conventional arts.

Applicant recognizes that a user's main physiological leverage range (based on the human body) is generally within a 45 degree range (with decreasing effect to an outer range of approximately 65-85 degrees on either side of the vertical position shown (as well as the safest range distance from support surface 201), and is noted as second and third arcs A' and C' (shown here as the position of arc C in FIG. 2C for contrast-reasons), respectively. During use, user hand 200H applies pressure or leverage to pry end 202 of bar and rolls the outer surface of hook end 201' along support surface 201, thereby applying sufficient urging force to nail shank 216 to remove the same. As shown here, second and third angles A', C' are approximately 70-90 degrees respectively and provide a number of benefits, including (i) the enhanced ergonomic efficiency of proper placement for a human user, (ii) the increased leverage provided by the continuous complex curve noted along the outer surface of hook portion 201', and (iii) the safety provided by having the same-side ends space central shaft 210 from the support surface to minimize user-hand pinching. As will be appreciated the final position of nail shank 216 when bar shank member 210 is at the end of arch C' is much greater than in the conventional art or the embodiment above, and as a consequence provides an additional leverage benefit.

Finally, it is recognized that the use of a continuous complex curve with an initial low relative angle Z, allows the user to impart smoothly applied power/leverage throughout the beneficial use zone in a continuous movement from first position to third position along a throw distance 120" (approximately 4-4.5 cm in contrast to the conventional geometry above B bar lengths being generally equal) that is having a throw distance substantially shorter than throw distance 120 in the conventional art at more than 6.5 cm.

As is depicted in FIG. 3C, a distance 213 is defined between the center of bar shank member 210 and an outermost curve tangent that is parallel with the centerline. Due to the increased distance 213 safety and user comfort are maintained while allowing a user's hands (on co-bar pry end 202) to be safely distanced from support surface 201 throughout the range of maximum arc C'. As a consequence, there is both increased user comfort and an enhanced leverage range within the same device.

Referring now specifically to FIG. 3D, combination bar 200 is shown with pry end 202 engaging shaft 216 of a nail and nail slot 207 formed between sharp points 208, 208 surrounding the same. Support surface 201 is noted and a throw distance D3 is defined between the maximum outer curvature of hook end 201' and contact surface 201. During use, it will be recognized that throw distance D3 is necessarily greater than conventional throw distance D1 noted above due to the hook direction, thereby providing an enhanced leverage to remove nail shaft 216.

An additional benefit is readily apparent from FIG. 3D as well, in circumstances where the user experiences difficulty placing nail slot 207 about nail shaft 216, additional force F2" may be applied along a surface perpendicular to the general centerline of bar shank member 210. The application of force F2" therefore occurs on a portion of the outer hook curve and at a region 212. As will be noted, region 212 is both approximately aligned with the force transfer direction minimizing bending motion/forces, and is applied to a generally thicker and more rigid portion of hook end 201' thereby minimizing substantive elastic motion and detrimental spring back with a resultant similar ergonomic and leverage benefit.

The steps by which the method for removing nails has been detailed at length in describing the tool bar and is use in carrying out the herein claimed method.

One of skill in the art having reviewed the above details will recognize a number of significant improvements over the conventional art discussed. These improvements include but are not limited to (i) improved working range of motion from initial position to optimal position to maximum position allowing increased leverage and ergonomic function; (ii) elimination or minimization of off-center force application resulting in a corresponding drop in detrimental elastic deformation; (iii) improved ergonomic efficiency in initial nail seating on a hook end, upon holding the bar shank member and upon the prying motion for both hook and pry ends; and (iv) improved user comfort and hand safety in spacing hands from a contact surface during a range of motion.

As used herein the phrases throw, lever throw, or user throw, etc. shall be generally recognized by those of skill in the art as referring to an action of moving a lever or lever arm to cause work to occur—to move an object, to pry a nail, to lift an item such as a nail, or to activate a combination hand tool bar to do the same etc. As a consequence, the phrase a throw distance will be recognized as a broad phrase referring to the distance traveled to accomplish the work (pulling a nail) in question, and various types of throw distances are discussed herein as 120, 120', D1, D2 and elsewhere.

Additionally the phrase compound curve as used herein shall be recognized and generally representing an arc or curve portion having a discontinuous radius, a generally increasing or decreasing radius curve, or other geometric change relative to a curve or arc starting position.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A combination hand tool bar, comprising:

(a) a bar shank member spacing a hook end portion at a proximate end and a curved pry end portion at a distal end thereof;

(b) said bar shank member defining a first plane having a front side and a back side;

(c) said hook end portion rising in a plane opposite said curved pry end portion and forming a curve therefrom;

(d) said hook end portion and said curved pry end portion terminating on the same side of said first plane, whereby said hand tool bar provides increased lever throw and user comfort;

(e) a fixed angle defined between said hook end portion and said first plane being less than sixty (60) degrees, whereby said hand tool bar enables an increased leverage during a use; and (f) a second plane, arranged perpendicular to said first plane and extending along the length of said hand tool bar; wherein said bar shank member, said curved pry end portion, and said hook end portion are arranged along said second plane.

2. A combination hand tool bar, according to claim 1, further comprising:

a nail slot element on each of said hook end and said curved pry end portions.

3. A combination hand tool bar, according to claim 1, wherein:

said angle defined is preferably between approximately 35-55 degrees.

4. A combination hand tool bar, according to claim 3, wherein:

said angle is more preferably between approximately 40-50 degrees.

5. A combination hand tool bar, according to claim 1, wherein:

said angle defined is preferably between approximately 0-25 degrees.

6. A combination hand tool bar, according to claim 5, wherein:

said angle defined is more preferably between approximately 0-15 degrees.

7. A combination hand tool bar, according to claim 1, wherein:

(a) said hook end portion includes an outer arc surface comprising a complex curve; and (b) at least a portion of said complex curve having a tangent generally orthogonal to said first plane of said bar shank member, whereby a force transfer is improved during said use.

* * * * *